US005141479A

United States Patent [19]

Vanjani et al.

[11] Patent Number: 5,141,479

[45] Date of Patent: Aug. 25, 1992

[54] DRIVE ARRANGEMENT FOR A TREADMILL

[75] Inventors: Govind W. Vanjani; Michael A. Pitzer; Eugene W. Andert, Jr., all of Fort Wayne, Ind.

[73] Assignee: General Electric Company, Fort Wayne, Ind.

[21] Appl. No.: 562,308

[22] Filed: Aug. 3, 1990

[51] Int. Cl.[5] ..... A63B 23/06

[52] U.S. Cl. ..... 482/54

[58] Field of Search ..... 272/69, 96, 125, 127, 272/DIG. 6, 129; 318/613, 341, 376, 245, 803, 811, 812, 434, 244, 131

[56] References Cited

U.S. PATENT DOCUMENTS 3,426,227 2/1969 Miller et al. .
3,602,502 8/1971 Hampl .
3,606,320 9/1971 Erwin, Jr. .
3,711,812 1/1973 Cherry .
4,344,616 8/1982 Ogden .
4,374,587 2/1983 Ogden .
4,445,683 5/1984 Ogden .
4,602,779 7/1986 Ogden .
4,635,927 10/1987 Shu .
4,643,418 2/1987 Bart .
4,664,646 5/1987 Rorabaugh .
4,749,181 6/1988 Pittaway et al. .
4,842,266 6/1989 Sweeney, Sr. et al. .

FOREIGN PATENT DOCUMENTS 1400538 7/1975 United Kingdom .
1581610 12/1980 United Kingdom .

*Primary Examiner*—Richard J. Apley
*Assistant Examiner*—Glenn E. Richman
*Attorney, Agent, or Firm*—Ralph E. Krisher, Jr.

[57] ABSTRACT

A drive arrangement for a treadmill includes an electric motor having a stator winding and an armature winding connected in series with each other and in parallel with a rectified power source. The rectified power source has both a DC component and an AC component. The series-connected motor is capable of producing torque for driving the endless belt of the treadmill from both the AC component and the DC component of the power source. Speed control circuitry of the type normally used with DC motor drives can be employed, while reducing the degradation in motor performance which would occur if a DC motor is used due to the presence of the AC component in the rectified power source. Other features include the use of a speed measuring device mounted adjacent a rotating shaft of the motor to provide direct feedback of motor speed to the speed control circuitry.

11 Claims, 2 Drawing Sheets

DRIVE ARRANGEMENT FOR A TREADMILL

BACKGROUND AND SUMMARY OF THE INVENTION

The invention relates generally to a drive system for an exercise treadmill and, more particularly, to a drive system for an exercise treadmill which includes a motor capable of producing usable torque from either an AC or DC power source.

Exercise treadmills are used by hospitals, health clubs and individuals to measure and/or improve the aerobic and cardiovascular fitness of the treadmill user. Such treadmills typically comprise a frame which supports an endless belt having an exposed, relatively flat top surface several feet in length to accommodate the walking, jogging or running stride of the user. The belt is mounted between two rollers which, in turn, are mounted to the frame by bearings. An electrically powered drive motor is typically connected to at least one of the rollers by a V-belt and pulley arrangement, or similar mechanism. On more sophisticated treadmills, some form of speed control is usually provided so that the speed of movement of the exercise surface of the endless belt can be varied.

Both AC and DC drive motors have been used in exercise treadmills found in the prior art. AC drive motors are relatively simple and inexpensive to produce, maintain and operate. An AC power source (e.g., 115 v.a.c., 60 Hz.) is normally readily available to the user, eliminating the need for and extra expense associated with transformers, rectifiers or other power conversion devices. However, smooth and efficient speed control over a wide operating range is more difficult to attain when using an AC motor. Moreover, the torque requirements in a treadmill are not uniform, but rather vary as the users feet make contact with and leave the exercise surface. The response of a DC motor to such torque changes is generally smoother and faster than is the response of an AC motor.

U.S. Pat. No. 4,643,418 shows an example of a treadmill which uses an AC motor to drive the endless belt. The speed of the belt is controlled by a speed control potentiometer or rheostat (54) which has a graduated scale to set the speed of the AC motor. The speed control must be set to its "off" or "zero" position when terminating an exercise session. If the speed control has not been turned to its "off" position, prior to turning on the main power switch to begin exercising, the treadmill will not respond. Depending upon the size of the resistance "steps" used, this type of speed control is incremental in nature. The power dissipated in the resistance element is wasted, lowering the efficiency of the overall system and creating a need to safely dissipate heat generated by the current flowing through the resistance element. Finally, AC motors are relatively noisy in operation. This problem is exacerbated if a larger motor must be used due to the inefficiency introduced by the speed control circuitry.

A number of treadmills utilize DC motors to drive the endless belt. DC motors are often preferred due to the ease with which DC motors may be speed controlled across a relatively wide range. U.S. Pat. No. 4,635,927 shows an exercise treadmill which uses a DC motor and a pulse width modulated control system to control motor speed. According to the specification of this patent, this arrangement allows the motor to operate at a relatively high efficiency across a wide range of motor speeds when compared to "traditional" treadmills which utilize AC induction motors. However, the treadmill described in U.S. Pat. No. 4,635,927 draws its power from a 110 v.a.c., 60 Hz. source, which requires that a rectifier and filter be employed to convert the incoming AC power to DC power prior to connecting the source to the motor. These rectifier and filter circuits are imperfect so that the power supplied to the DC drive motor is actually a mixture of AC and DC power. The AC component of the power source degrades the performance of the DC motor, resulting in a decrease in operating efficiency. The decrease in efficiency may require that a larger DC motor be provided to assure satisfactory performance of the treadmill. An increase in motor size results in noisier operation and an increase in the overall size of the space required to accommodate the drive mechanism.

U.S. Pat. No. 4,664,646 describes a treadmill motor drive which utilizes a thin, high speed, low torque motor to drive the endless belt of the treadmill. This arrangement is contrasted to "prior art" treadmill motor drives in which bulkier high torque, low speed motors are used. The small size and light weight of this unit are desirable in a treadmill which is intended to be folded up or transported from one location to another on a regular basis. Reductions in bulk and weight may, of course, be desirable in stationary treadmills as well.

Other examples of treadmills having electric motor driven mechanisms can be found in U.S. Pat. Nos. 3,602,502; 3,606,320; 3,711,812; 4,344,616; 4,374,587; 4,445,683; 4,602,779; 4,635,927; 4,749,181; and 4,842,266.

An object of the present invention is to provide an electric motor drive arrangement for a treadmill which is relatively efficient in operation.

Another object of the present invention is to provide an electric motor drive arrangement for a treadmill which is relatively small and compact in design.

Yet another object of the present invention is to provide an electric motor drive arrangement for a treadmill which is relatively quiet in operation.

Yet another object of the present invention is to provide an electric motor drive arrangement for a treadmill which can be powered by an imperfectly rectified AC power source, while suffering relatively little performance degradation due to the presence of the AC power component in the rectified source.

These and other objects of the present invention are attained in a drive arrangement for an exercise treadmill having a frame and an endless belt mounted within the frame, comprising electric drive means for driving the endless belt to provide a moving exercise surface, means for receiving electrical power from an AC power source, and rectifier means for rectifying the AC power to provide a power source for the electric drive means. The power source provided by the rectifier has both a DC component and an AC component. The electric drive means comprises an electric motor having a stator winding and an armature winding connected in series with each other and in parallel with (i.e., across) the output of the rectifier.

The electric motor comprises a laminated stator supporting the stator winding, a wound rotor, a commutator which is electrically connected to the wound rotor, and a pair of brushes in contact with the commutator. The stator winding and brush holders are serially connected to each other (i.e., one end of the stator winding is connected to one of the brush holders) and in parallel with the rectifier output (i.e., the other end of the stator winding and the other brush holder are connected across the rectifier output). The series connected electric motor is capable of producing torque for driving the endless belt from both the AC component and the DC component of the rectified electric power source. The motor is mounted by means of resilient mounting bushings to the frame of the exercise treadmill.

In one embodiment of the invention, the rectifier further includes a control system for controlling the rotational speed of the electric motor. The control system includes a motor speed measuring device which is mounted adjacent a rotating shaft of the electric motor. The measuring device is an electromagnetic tachometer providing a variable frequency signal.

The inventors have recognized that power supplies and rectifiers of the type commonly used in treadmills are imperfect. The rectified DC power, which is normally supplied to a DC motor, has an AC component which degrades the performance of the DC motor, resulting in motor inefficiencies, increased noise levels, and other disadvantages. The inventors have discovered that providing a series connected motor (sometimes referred to as a "universal" motor) which is powered from a source of the type typically used to power a DC motor (i.e., a rectified DC source having an AC component) addresses these problems since the AC component of the power source does not degrade the performance of the series connected motor. Accordingly, a smaller, more efficient motor can be used and noise levels and space requirements are reduced.

Other objects, advantages and novel features of the present invention will become apparent from the following detailed description of the invention when considered in conjunction with the accompanying drawings.

DETAILED DESCRIPTION OF THE DRAWINGS

Figure 1:
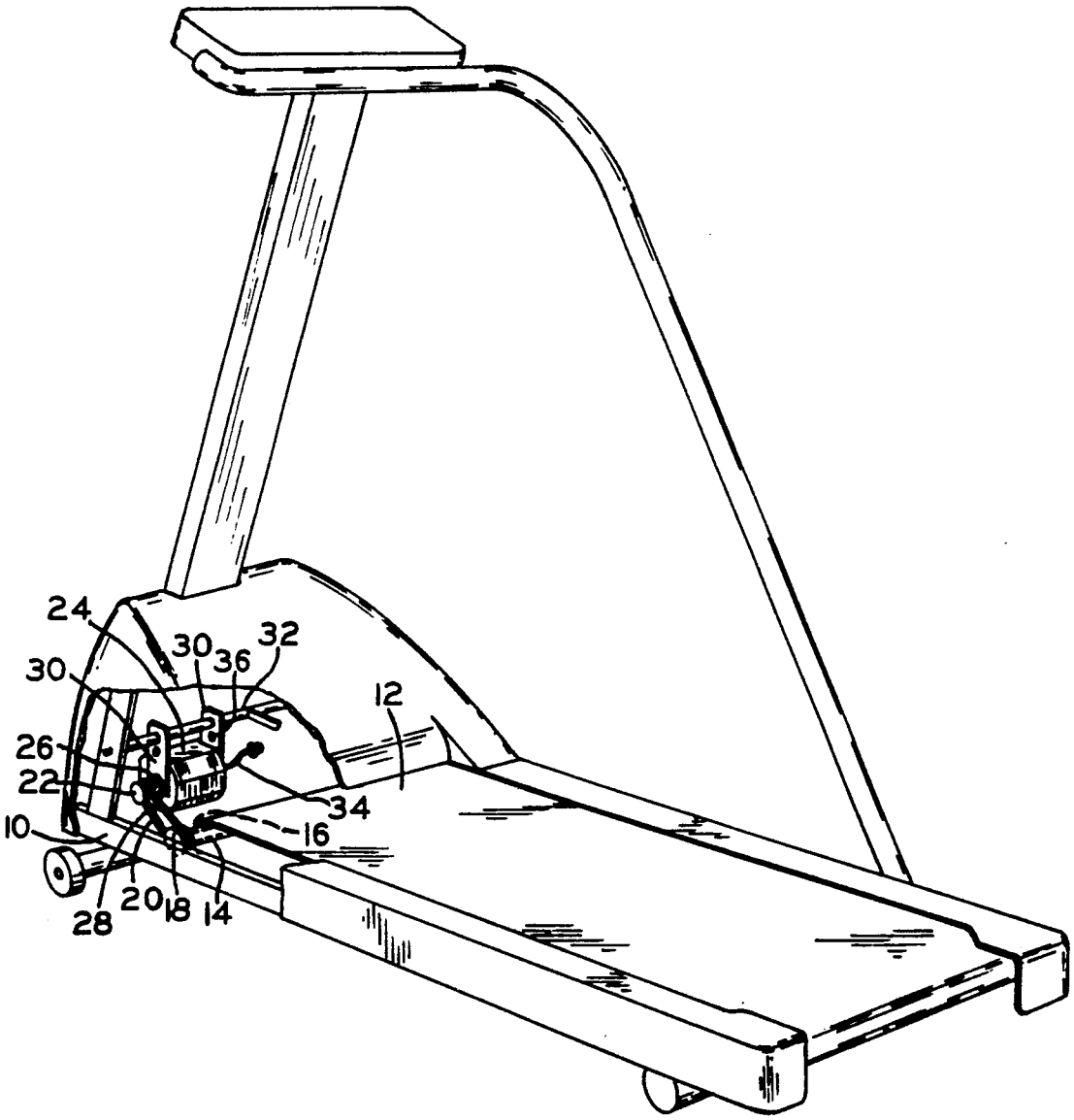
FIG. 1 shows a partial, cut-a-way view of a treadmill assembly which utilizes a drive arrangement in accordance with the present invention.

FIG. 1 shows a portion of a treadmill assembly, in cut-a-way form, which utilizes the drive arrangement of the present invention. The treadmill assembly of FIG. 1 includes a frame 10 which provides support for the other major components. An endless belt 12 is mounted to the frame by a pair of rollers 14, only one of which is shown in FIG. 1. The rollers are rotatably mounted on shafts 16 by bearings (not shown) which are mounted to frame 10. On one end of forward-most roller 14 is a pully 18 which is connected by a V-belt 20 to a smaller puller 22. Pulley 22 is mounted on the shaft of an electric motor 24. Electric motor 24 is series-connected motor which, as will be explained in additional detail below, is supplied with power from a rectified AC power source.

Motor 24 is supported by two resilient mountings 26 which are surrounded by split brackets 28 which, in turn, are suspended from supports 30. Supports 30 are mounted to shaft 32. Shaft 32 is, in turn, mounted to frame 10. Power is supplied to motor 24 by electrical wires 34 which are routed through an opening 36 in support 30.

Figure 2:
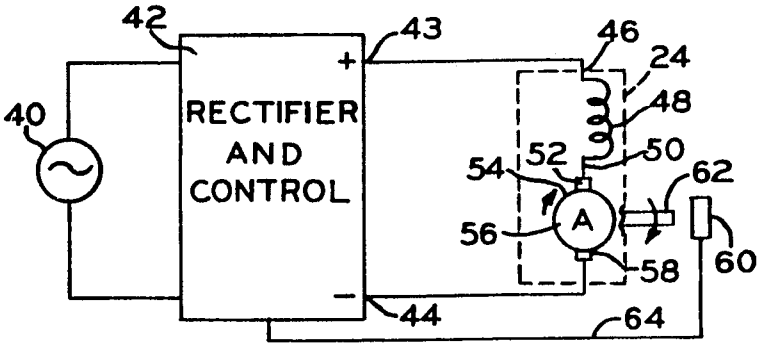
FIG. 2 shows, in diagrammatic form, a drive arrangement for an exercise treadmill powered by a series-connected motor.

FIG. 2 shows, in schematic form, the drive arrangement for the treadmill assembly of FIG. 1. FIG. 2 includes an AC power source 40 which may typically be a wall outlet or other conveniently available source of 115 VAC, 60 Hz. electrical power. AC power source 40 is connected to the inputs of a rectifier and control module 42. The outputs 43 and 44 of module 42 are connected to stator winding 48 and armature 56, respectively, of a series-connected motor which corresponds to motor 24 of FIG. 1. Output 43 is connected to first end 46 of stator winding 48. Second end 50 of stator winding 48 is connected to brush 52 which is positioned on commutator 54 of armature 56. Opposing brush assembly 58 is connected to output 44 of module 42.

Motor 24 is provided with a speed measuring device 60 which is mounted adjacent rotating motor shaft 62 in the schematic of FIG. 2. Device 60 is connected to module 42 by electrical conductor 64 to provide a source of direct feedback of motor speed to module 42.

Figure 3:
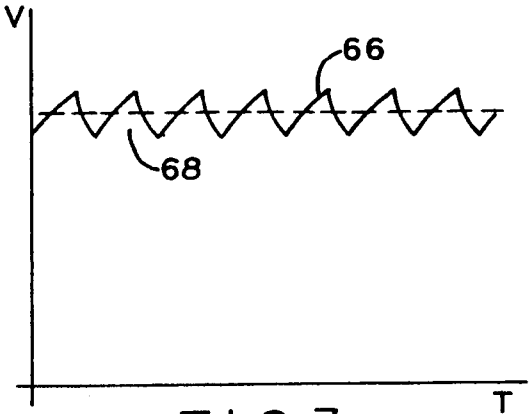
FIG. 3 shows the shape of the waveform typically generated by a rectifier in a treadmill assembly.

FIG. 3 illustrates the shape of the waveform 66 across outputs 43 and 44 of rectifier and control module 42. Waveform 66 includes a DC component, represented by dashed line 68 and an AC component which results from incomplete filtering of the rectified AC sine wave. This AC component, which may be greater or smaller depending upon the extent of filtering provided, degrades the performance of DC motors of the type frequently used in treadmills. This requires that a correspondingly larger motor be provided to attain a specified level of performance, resulting in a relatively inefficient assembly, increased noise levels, and other disadvantages. However, series-connected motor 24 of FIG. 2 is capable of deriving usable torque from both the AC component and the DC component of waveform 66. The AC component of the power source does not degrade the performance of the series connected motor to the same degree that occurs in the case of a DC motor. This means that a smaller, more efficient motor which generates less noise and takes up less space may be used in a specified application. Alternatively, a lesser degree of filtering may be provided without degrading the performance of the motor to the same extent as would occur if a DC motor is used.

Figure 4:
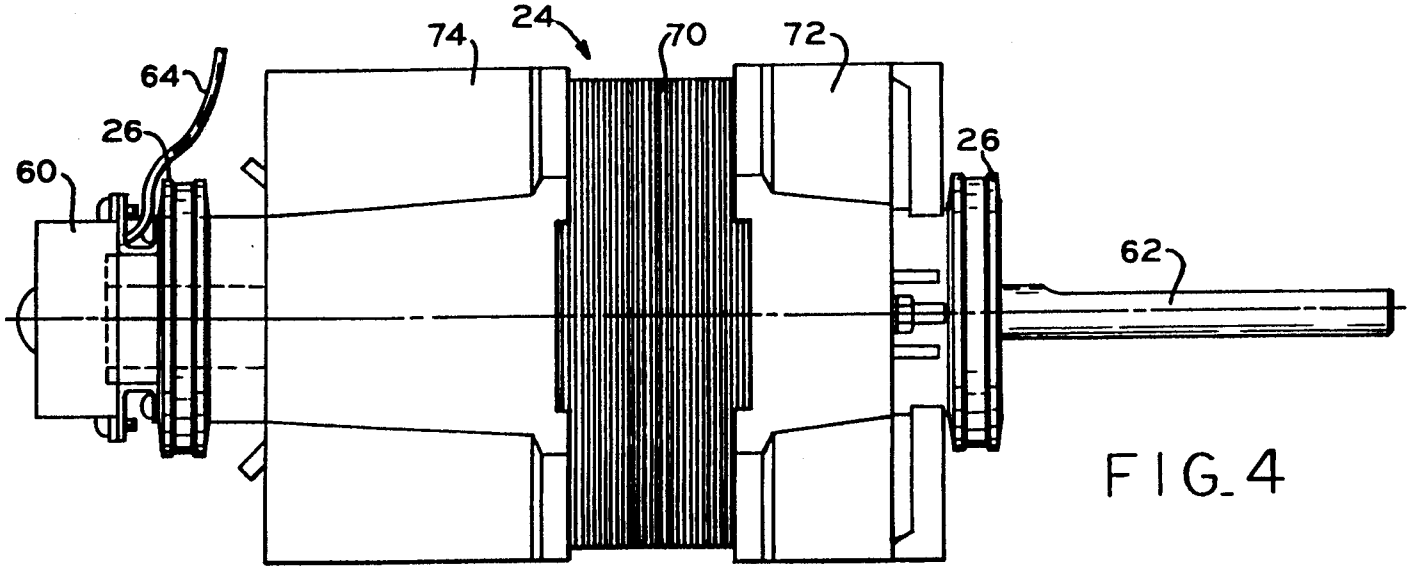
FIG. 4 shows a side view of a series-connected motor for use in a drive arrangement for the exercise treadmill.

FIG. 4 shows a side view of a series-connected motor for use in a drive arrangement for an exercise treadmill. The motor of FIG. 4 corresponds generally to motor 24 of FIGS. 1 and 2. Where possible, like reference numerals will be used for like components for purposes of clarity.

Motor 24 of FIG. 4 comprises a laminated stator 70 which is secured between two cast end shields 72 and 74. Mounted immediately adjacent end shields 72 and 74 are resilient mountings 26 by which motor 24 is secured to frame 10 of the treadmill assembly. Shaft 62 extends from one end of motor 24 adjacent end shield 72 and is adapted to receive pulley 22, as illustrated in FIG. 1. Speed measuring device 60 is disposed adjacent the opposing end of shaft 62. Device 60 is connected by conductor 64 to control 42. As previously discussed, speed measuring device 60 is an electromagnetic tachometer providing a variable frequency signal, although other types of speed measuring sensors may be used.

From the preceding description of the preferred embodiments, it is evident that the objects of the invention are attained. Although the invention has been described and illustrated in detail, it is to be clearly understood that the same is intended by way of illustration and example only and is not to be taken by way of limitation. The spirit and scope of the invention are to be limited only by the terms of the appended claims.

What is claimed is:

1. A drive arrangement for an exercise treadmill having a frame and an endless belt mounted within the frame, comprising:

electric drive means for driving the endless belt to provide a moving exercise surface;

means for receiving electric power from an AC power source; and rectifier means for rectifying the AC power to provide a power source for the electric drive means, said power source having a DC component and an AC component, wherein said electric drive means comprises a universal electric motor capable of producing torque for driving the endless belt from both the DC and AC component of the power source, and said universal motor having a stator winding and an armature winding connected in series with each other and in parallel with said rectifier means so as to prevent the AC component of the power source from degrading the performance of the drive means.

2. A drive arrangement for an exercise treadmill according to claim 1, wherein said rectifier means further comprises control means for controlling the rotational speed of the electric motor.

3. A drive arrangement for an exercise treadmill according to claim 2, wherein said control means comprises speed measuring means mounted adjacent a rotating shaft of said electric motor.

4. A drive arrangement for an exercise treadmill according to claim 3, wherein said speed measuring means comprises an electromagnetic tachometer.

5. A drive arrangement for an exercise treadmill according to claim 1, wherein said electric motor comprises a laminated stator supporting said stator winding, a wound rotor, a commutator, and a pair of brushes in contact with said commutator, and wherein said stator winding and said brush holders are serially connected to each other and in parallel with said rectifier means.

6. A drive arrangement for an exercise treadmill according to claim 1, wherein said motor is provided with resilient mounting means for mounting to the frame of the exercise treadmill.

7. A drive arrangement for an exercise treadmill having a frame and an endless belt mounted within the frame, comprising electric drive means for driving the endless belt to provide a moving exercise surface, means for receiving electrical power from an AC power source, and rectified means for rectifying the AC power to provide a rectified source of power for the electric drive means, said rectified power source having a DC component and an AC component, wherein said electric drive means comprises a universal electric motor which produces torque for driving the endless belt from both the AC component and the DC component of said electric power source, and which has serially connected stator and armature windings so as to prevent degradation of the performance of the drive means by the AC component of the rectified power source.

8. A drive arrangement for an exercise treadmill according to claim 7, wherein said rectifier means further comprises control means for controlling the rotational speed of the electric motor.

9. A drive arrangement for an exercise treadmill according to claim 8, wherein said control means comprises speed measuring means mounted adjacent a rotating shaft of said electric motor.

10. A drive arrangement for an exercise treadmill according to claim 9, wherein said speed measuring means comprises an electromagnetic tachometer.

11. A drive arrangement for an exercise treadmill according to claim 6, wherein said electric motor has a stator winding and an armature winding connected in series with each other and in parallel with said rectifier means.

* * * * *